US005436602A

United States Patent [19]

McVeety et al.

[11] Patent Number: 5,436,602

[45] Date of Patent: Jul. 25, 1995

[54] CERAMIC FILTER WITH A TRANSMISSION ZERO

[76] Inventors: Thomas McVeety, 164 Pueblo Luna Dr., NW., Albuquerque, N. Mex. 87107; David G. Clifford, Jr., 726-15 Tramway Vista Dr., NE., Albuquerque, N. Mex. 87122

[21] Appl. No.: 234,339

[22] Filed: Apr. 28, 1994

[51] Int. Cl.[6] ..... H01P 1/205

[52] U.S. Cl. ..... 333/206; 333/207

[58] Field of Search ..... 333/202–207, 333/222, 223

[56] References Cited

U.S. PATENT DOCUMENTS

| | | | |
|---|---|---|---|
| 4,523,162 | 6/1985 | Johnson | 333/203 X |
| 5,146,193 | 9/1992 | Sokola | 333/206 |
| 5,218,329 | 6/1993 | Vangala et al. | 333/206 |
| 5,307,036 | 4/1994 | Turunen et al. | 333/206 X |
| 5,321,374 | 6/1994 | Uwano | 333/207 X |

*Primary Examiner*—Seungsook Ham

*Attorney, Agent, or Firm*—Gary J. Cunningham

[57] ABSTRACT

A ceramic filter with a high side transmission zero. The ceramic filter (10) has: a filter body (12) of a dielectric material having top, bottom and side surfaces (14, 16, 18, 20, 22, 24). Two through-holes extending from the top (14) to the bottom surface (16), defining resonators (26,28) are included. The surfaces are substantially covered with a conductive material, defining a metallized layer (30), with the exception that the top surface (14) is substantially uncoated and with the additional exception that a portion of the side surface is also uncoated (32) in proximity to the bottom surface (16), and it extends laterally at least in proximity to the resonators (26,28), defining a magnetic transmission line (32) for magnetically coupling the resonators (26,28). Surface mountable first and second input-output pads (34,38) are also provided.

7 Claims, 2 Drawing Sheets

CERAMIC FILTER WITH A TRANSMISSION ZERO

FIELD OF THE INVENTION

This invention relates generally to filters, and in particular, to ceramic filters with a transmission zero.

BACKGROUND OF THE INVENTION

Filters are known to provide attenuation of signals having frequencies outside of a particular frequency range and little attenuation to signals having frequencies within the particular frequency range of interest. As is also known, these filters may be fabricated from ceramic materials having one or more resonators formed therein. A ceramic filter may be constructed to provide a lowpass filter, a bandpass filter or a highpass filter, for example.

For bandpass filters, the bandpass area is centered at a particular frequency and has a relatively narrow bandpass region, where little attenuation is applied to the signals. For example, the center frequency may be at 750 Mega Hertz (MHz) with a bandpass region of less than 2 MHz. While this type of bandpass filter may work well in some applications, it may not work well when a wider bandpass region is needed or special circumstances or characteristics are required.

Block filters typically use an electroded pattern printed on an outer (top) surface of the ungrounded end of a combline design. This pattern serves to load and shorten resonators of the combline filter. The pattern helps define coupling between resonators, and can define locations of transmission zeroes.

These top metallization patterns are typically screen printed on the ceramic block, which can be difficult and time consuming in the manufacturing process. Many block filters include chamfered resonator through-hole designs to facilitate this process by having the loading and coupling capacitances defined within the block itself, to facilitate and simplify the manufacturing process. The top chamfers help define the intercell couplings and likewise define the location of the transmission zero in the filter response. This type of design typically gives a response with a low side zero. To achieve a high side transmission zero response, chamfered through-holes are placed in the grounded end (bottom) of the ceramic block filter. Thus, a high zero response ceramic filter would typically have chamfers at both ends of the dielectric block. A double chamfer filter is more difficult to manufacture because of the tooling requirements, and precise tolerances and required structure in making double chamfered through-holes at the top and bottom surfaces of the filter.

A bandwidth of a filter can be designed for specific passband requirements. Typically, the wider the passband, the lower the insertion loss, which is an important electrical parameter. However, a wider bandwidth reduces the filter's ability to attenuate unwanted frequencies, typically referred to as the rejection frequencies. The addition of a transmission zero in the transfer function at the frequency of the unwanted signal could effectively improve the performance of a ceramic block filter, as detailed below.

A ceramic filter which can be easily manufactured to manipulate and adjust the frequency response, preferably with a high side zero, to attenuate unwanted signals, could improve the performance of a filter and would be considered an improvement in ceramic filters.

DETAILED DESCRIPTION OF THE PREFERRED EMBODIMENT

Figure 1:
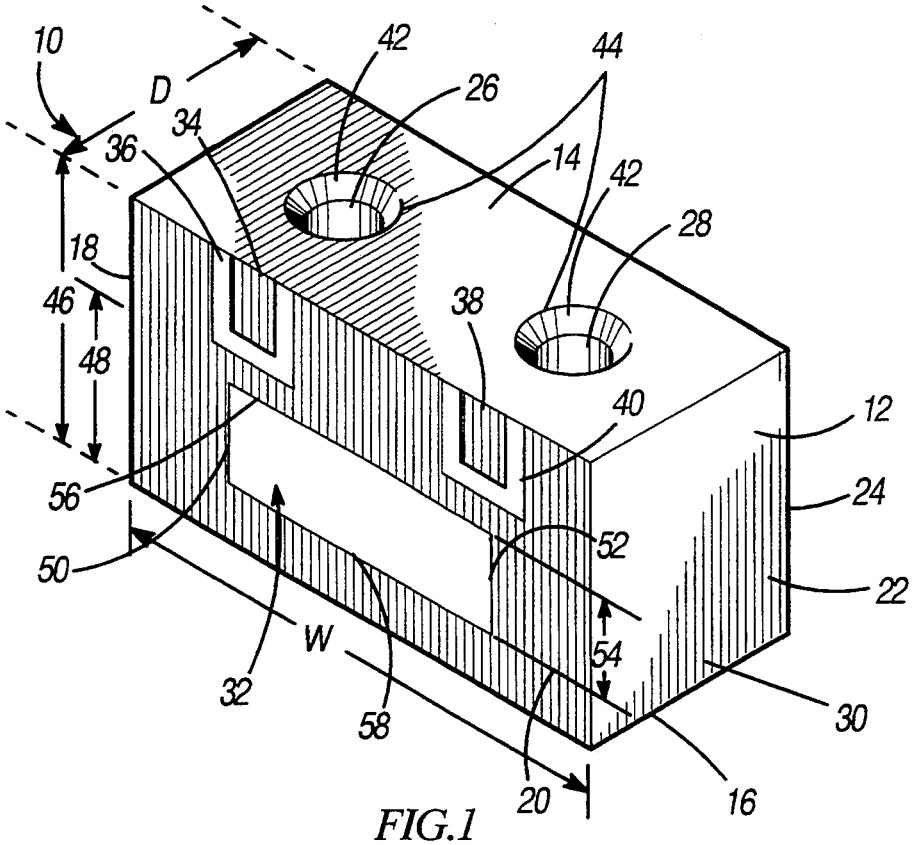
FIG. 1 is an enlarged, perspective view of a ceramic filter with a transmission zero, in accordance with the present invention.

In FIG. 1, a ceramic filter is shown which has a passband for passing a desired frequency and a transmission zero on a high side of the passband. The ceramic filter 10, includes a filter body 12 having a block of dielectric material and having top and bottom surfaces 14 and 16, and side surfaces 18, 20, 22 and 24. The filter body 12 has a plurality of through-holes extending from the top to the bottom surface 14 to 16, defining resonators. The surfaces 16, 18, 20, 22 and 24 are substantially covered with a conductive material defining a metallized exterior layer, with the exception that the top surface 14 is substantially uncoated comprising the dielectric material, and with an additional exception that a portion of the side surface is substantially uncoated comprising the dielectric material in proximity to the bottom surface 16 and extending at least in proximity to between the resonators, defining a magnetic transmission line 32 for magnetically coupling the resonators. The ceramic filter 10 also includes first and second input-output pads 34 and 38 comprising an area of conductive material on at least one of the side surfaces and substantially surrounded by at least one or more uncoated area 36 and 40 of the dielectric material.

The ceramic filter can be made with a desired frequency response, with fairly simple modifications and changes, so long as the magnetic transmission line is suitably positioned to provide the desired frequency response. Another advantage of this invention, is that a top chamfered through-hole is easier to manufacture and modify than through-holes with chamfers at or near the top and bottom surfaces. The ceramic filter 10 can be made and tuned with a lapping step, in which the ceramic block is lapped to a specified length L, identified as item 46. This length defines the length of the resonators and the resonant frequency of the filter. Lapping a single (top) chamfer block is less problematic than a double chamfer block. Further, double chamfer blocks are typically required for a high side zero response. By omitting the bottom chamfers, the magnetic transmission line 32, defined by a void or unmetallized area in the layer 30 (ground plane), can contribute to providing a simplified structure and less costly manufacturing process. The ceramic filter 10 is particularly adapted for use in connection with radios, cellular phones and other electronic devices.

Figure 2:
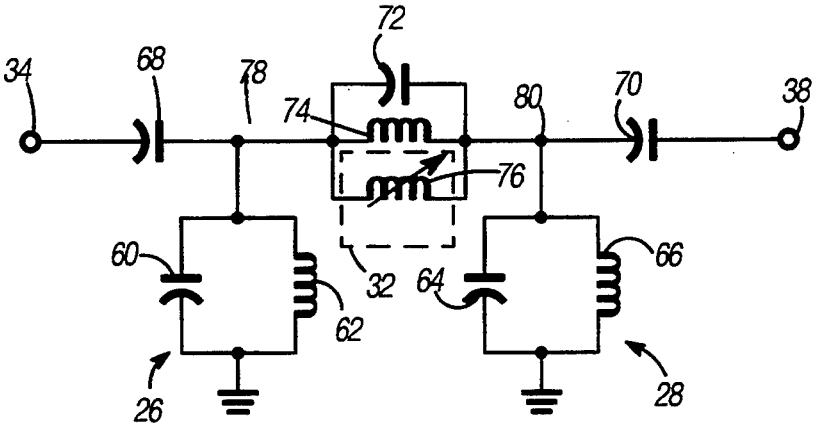
FIG. 2 is an equivalent circuit diagram of the ceramic filter shown in FIG. 1, in accordance with the present invention.

Referring to FIG. 2, the input and output are designated as 34 and 38, respectively, and the first and second resonators are shown as items 26 and 28. Resonator 26 includes a capacitor 60 and inductor 62 in parallel coupled between ground and node 78. The second resonator 28 includes a capacitor 64 and inductor 66 also coupled between ground and a node 80. The input 34 is coupled to node 78 via capacitor 68. Similarly, the output 38 is connected to node 80 via capacitor 70. Capacitor 68 and 70, are substantially defined by the distance between the input-output pads 34 and 38 and the chamfers 42, in FIG. 1.

Connected in parallel between nodes 78 and 80 are capacitor 72, inductor 74 and magnetic transmission line 32, preferably including a variable inductor 76. The value of capacitor 72 is substantially defined by the distance between the chamfers 42 in FIG. 1. The value of the fixed inductor 74 is substantially determined by the distance between the through-holes 26 and 28 in FIG. 1, near the bottom 16. And finally, the value of the variable inductor 76 is defined by the overall dimensions and geometry of the magnetic transmission line 32. The line 32 includes a vertical width component 54 and predetermined lateral distance between the first and second end portions 50 and 52, in FIG. 4.

In one embodiment, the resonators 26 and 28 have chamfered upper portions 42 in proximity to the top surface 14. In a preferred embodiment, the chamfered cavity (which is an upper portion of the through-holes 26 and 28), is generally funnel-shaped so as to provide a narrower gap 44 therebetween, near the top surface 14 and a wider gap 45 below the chamfers 42.

The narrow capacitive gap 44 between the chamfered upper portions 42 of the first and second resonators 26 and 28, and a wider inductive gap 45 between the lower sections of the resonators 26 and 28, the latter provides a lightly loaded coupling near the resonators ground. The high mutual capacitance between the resonators, and the light coupling of the resonators near the bottom surface 16 (or ground), drives the transmission zero down in frequency, below the bandpass region. It also widens the bandpass region. The top surface 14 and bottom surface 16, are free of metallization and completely filled with metallization, respectively, to contribute to providing the desired frequency response, as shown for example in FIG. 3.

The ceramic filter 10 includes a predetermined length L, identified as item 46, which is defined as the distance from the top to the bottom surfaces 14 to 16. The magnetic transmission line 32 is located at or below an area about one third of the way from the bottom surface 16 (and between and substantially parallel to the top and bottom surface 14 and 16), identified as item 48, in FIG. 1.

The positioning of the magnetic transmission line 32 is by necessity, in the area of magnetic activity of the filter 10. In a combline design, substantially all the magnetic activity takes place at or in proximity to the grounded end (in proximity to the bottom 16) of the filter block. Therefore, the magnetic transmission line 32 is strategically positioned in this region to have positive influence over the frequency response, and preferably with the placement of the transmission zero on the high side of the passband.

Figure 3:
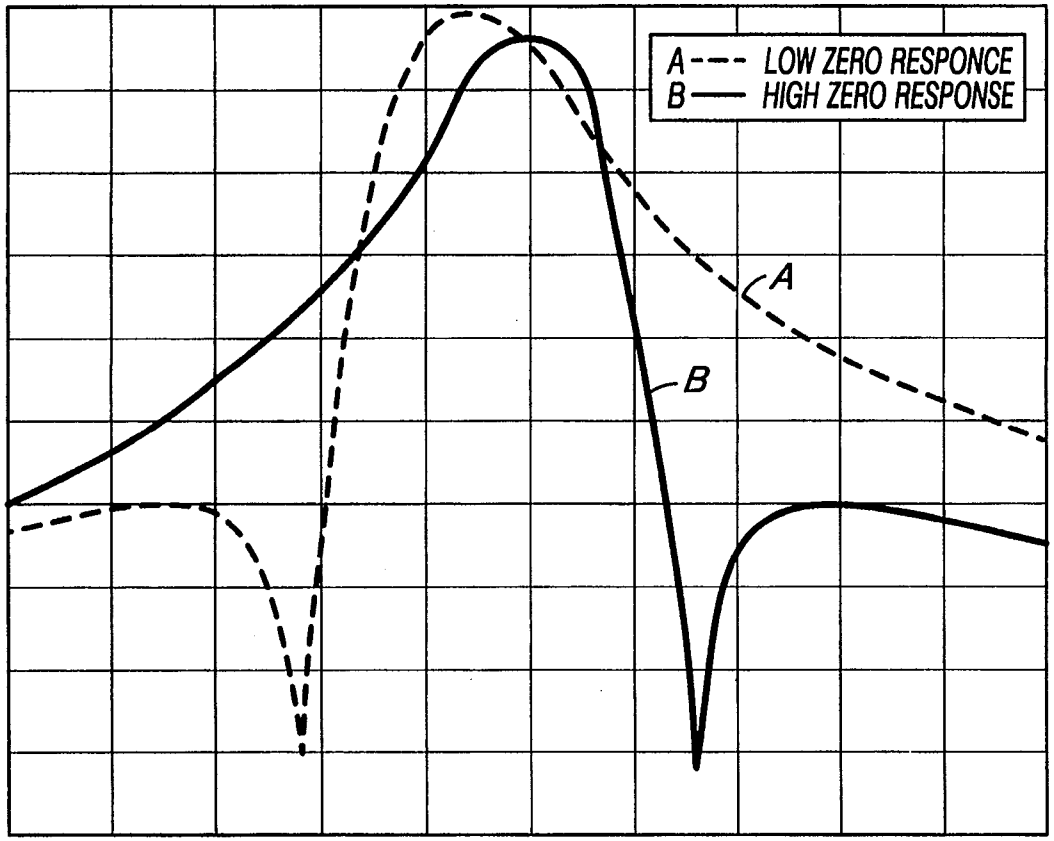
FIG. 3 shows a frequency response of a ceramic filter substantially as shown in FIG. 1, in accordance with the present invention, compared to a conventional ceramic filter without a magnetic transmission line in FIG. 1.

In a preferred embodiment, combline filters such as filter 10, are suitably shortened from about a quarter wavelength (90° transmission line), which is defined by length L, item 46. This reduction is accomplished by the loading capacitances defined by the chamfers 42. In the filter 10, the magnetic transmission line 32 is positioned in an area of suitable magnetic activity. In a preferred embodiment, the line 32 is positioned about 40° from ground 0° (bottom 16) or less, and sufficiently above the grounded end 0° for a more reliable and controllable frequency response, more preferably about 40° to about 10°, above the grounded end in order to provide the desired frequency response. Referring to FIG. 3, by placing a magnetic transmission line 32 at a suitable location, a response curve like that shown as item B, having a high zero response, is obtainable. The magnetic transmission line 32, is shown in the circuit diagram in FIG. 2, as a variable inductor 76, which is dependent on the geometry, positioning and dimensions of the transmission line 32, as detailed herein.

In a preferred embodiment, the magnetic transmission line 32 is strategically placed and positioned in proximity to area 48 or below, preferably about one-third or below the distance L, identified as item 46, in proximity to the bottom surface 16. By using a larger void area to make up the transmission line 32, comprising substantially only the dielectric material, a larger magnetic transmission line having a higher inductive value is attainable. More energy may be coupled between the resonators in this structure, which allows the transmission zero to be adjustable.

By careful placement of line 32, a desired response can be defined more easily and substantially independent of the initial manufacture of the ceramic filter, without the transmission line 32. Stated another way, the structure of filter 10 is adapted to allow a manufacturer to make a generic type of ceramic filter, and at a later date, can easily modify and manipulate the frequency response, and in turn provide different models exhibiting various specified responses, by including the transmission line 32, which is advantageous from a manufacturing point of view.

In a preferred embodiment, the magnetic transmission line 32 is positioned between about one-third the length L 46 and sufficiently above the bottom surface 16, to provide the desired transmission zero above the bandpass region, as shown for example in FIG. 3, curve B. The transmission line 32 location is suitably positioned in the area of magnetic activity of the filter 10, as detailed above. If the location is above area (line) 48 for example, the transmission line 32 (void) would typically serve no purpose other than to change the intercell couplings. However, if properly positioned, in accordance with the parameters discussed herein, and considering the structure, size, chamfers, dielectric value of the ceramic block 12, spacing between the resonators, etc., a frequency response can be achieved, substantially as shown by item B, in FIG. 3. If on the other hand, the location of the magnetic transmission line 32 is placed too low, for example, to or exceedingly near the bottom surface 16, the resonators can be detuned to a lower resonant frequency and may be more difficult to control. In a preferred embodiment, the magnetic transmission line 32 is positioned from about 40° to about 10° from the grounded end (or bottom 16), to obtain the desired frequency response, as shown by item B in FIG. 3.

In a preferred embodiment, the transmission line 32 is positioned above the bottom surface 16 on the front surface 20 about one-tenth L or more and below item 46. Alternatively, the magnetic transmission line 32 can be positioned on the rear side 24, if desired, so long as suitable magnetic coupling is provided. In some applications, this structure may be preferred, to appropriately and suitably place the magnetic transmission line 32 away from the related circuitry in an electronic device.

Figure 4:
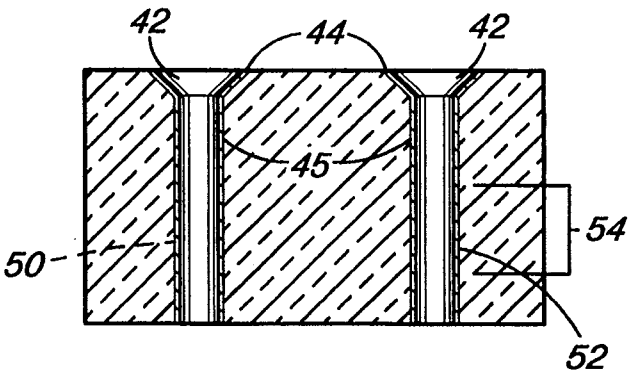
FIG. 4 is a cross-sectional view of the ceramic filter shown in FIG. 1, in accordance with the present invention.

Referring to FIG. 4, the magnetic transmission line 32 extends substantially laterally and horizontally, to provide a suitable coupling between the resonators 26 and 28, in proximity to the bottom surface 16 (or grounded end). The magnetic transmission line 32 includes a first end portion 50 and a second end portion 52 which extend horizontally from and magnetically couple the first and second resonators 26 and 28. In a preferred embodiment, the first and second end portion 50 and 52 couple and extend laterally to the outer portions of the (through-holes) resonators 26 and 28, as shown in FIG. 4, for improved characteristics.

In a preferred embodiment, the magnetic transmission line 32 extends laterally to sufficiently couple the lower portions of the resonators 26 and 28, and more preferably the end portions 50 and 52 extend laterally outwardly at least to the outer portions of the resonators 26 and 28 so as to magnetically couple most of the magnetic energy available at that location, by taking advantage of all or substantially all of the magnetic energy available in this area.

The magnetic transmission line 32 includes a predetermined width 54 sufficient to provide a suitable coupling. The width 54 is carefully chosen to provide the desired response. If the width is excessively wide or narrow, the desired frequency response will not be obtained, because the inductive or magnetic coupling will be too high or low, for example. In one embodiment, the width is about one-third of L or less for the desired response. Stated another way, the width 54 is about 30° wide, and preferably about 25° wide for a desired response.

Moreover, the width 54 can be used to adjust and compensate for small manufacturing deviations, if necessary. Thus, the dimensions and placement of the magnetic transmission line 32 are essential to accurately position the transmission zero to obtain the desired frequency response of the filter, and can also be used to compensate for minor manufacturing deviations.

In one embodiment, the resonators 26 and 28 have chamfered upper portions 42 and the filter body 12 includes an exterior unmetallized portion (or void) defined as the magnetic transmission line 32, to provide the desired placement of the transmission zero above the bandpass region.

COMPARATIVE EXAMPLE A

A ceramic filter substantially as shown in FIG. 1, was made without the magnetic transmission line 32. The filter of Comparative Example A was tested, and the plot or frequency response is shown as item A, in FIG. 3. The dimensions were as follows: length 0.357 inches (9.07 mm), width 0.3 inches (7.62 mm); and depth 0.17 inches (4.32 mm). The through-holes had a diameter of 0.0625 inches (1.5 mm) and a spacing apart from the mid-points of the through-holes of 0.130 inches (3.2 mm). The Comparative Example A also included the chamfered upper portions 42 and the input-output pads 34 and 38. The frequency response of Comparative Example A is shown as item A in FIG. 3. The low side transmission zero is provided substantially by the chamfered structure. The ceramic material was a Neodymium doped Barium Tetratitanate with a dielectric value of 80.

EXAMPLE 1

The previously described ceramic filter of Comparative Example A, was modified to include the magnetic transmission line 32, shown in FIG. 1. The dimensions and geometry of the magnetic transmission line were as follows. The horizontal length between the end portions 50 and 52 in FIG. 4, was 0.230 inches (5.84 mm), and extended laterally to include the resonators (through-holes), as shown in FIG. 4. The width, as defined by item 54 was 0.1 inches (2.54 mm). The transmission line 32 includes a top portion 56 positioned 0.15 inches (3.8 mm) from the bottom and about 38° from the grounded end (bottom 16) and a bottom portion 58 positioned 0.05 inches (1.27 mm) from the bottom and about 13° from the grounded end. The frequency response is shown as item B, in FIG. 3. The high side zero, advantageously eliminates the unwanted signals. This filter is particularly adapted for use as an interstage bandpass filter in a portable receiver.

Although the present invention has been described with reference to certain preferred embodiments, numerous modifications and variations can be made by those skilled in the art without departing from the novel spirit and scope of this invention.

What is claimed is:

1. A ceramic filter with a transmission zero, comprising:

a filter body comprising a block of dielectric material and having top, bottom and side surfaces, and having a plurality of metallized through-holes extending from the top to the bottom surfaces defining resonators, the surfaces being substantially covered with a conductive material defining a metallized layer, with the exception that the top surface is uncoated, and with an additional exception that a portion of one of the side surfaces is substantially uncoated in proximity to the bottom surface defining a magnetic coupling between the resonators;

the magnetic coupling is positioned above the bottom surface and below about one-third or less of the distance from the bottom to the top surface, and extends substantially laterally in proximity to the resonators with a substantially uniform width; and first and second input-output pads comprising an area of conductive material on at least one of the side surfaces and substantially immediately surrounded by an uncoated area of the dielectric material.

2. The filter of claim 1, wherein the resonators have chamfered upper portions in proximity to the top surface.

3. The filter of claim 1, wherein the magnetic coupling is substantially rectangularly shaped sufficient to provide the desired coupling.

4. The filter of claim 1, wherein the magnetic coupling is positioned above the bottom surface about one-tenth or more of the distance from the bottom surface to the top surface on at least one of a front side surface and a rear side surface.

5. The filter of claim 1, wherein the magnetic coupling portion extends substantially laterally such that first and second end portions of the magnetic coupling are in proximity to and adjacent with the resonators.

6. A ceramic filter with a transmission zero, comprising:

a filter body comprising a block of dielectric material and having top, bottom and side surfaces, and having a plurality of metallized through-holes extending from the top to the bottom surfaces defining resonators, the surfaces being substantially covered with a conductive material defining a metallized layer, with the exception that the top surface is substantially uncoated and with an additional exception that a portion of one of the side surfaces is uncoated defining an uncoated portion in proximity to the bottom surface;

the filter body comprises a quarter wavelength filter including about 90° from the bottom surface to the top surface, and the uncoated portion is positioned from about 40° to about 10° from the bottom surface;

the uncoated portion is positioned to provide a desired frequency response with a transmission zero on a high side of a passband of the desired frequency response, and the uncoated portion has a substantially vertical uniform width and extends substantially horizontally in proximity to the resonators, defining a magnetic coupling for magnetically coupling the resonators; and first and second input-output pads comprising an area of conductive material on at least one of the side surfaces and substantially immediately surrounded by an uncoated area of the dielectric material.

7. The filter of claim 6, wherein the uncoated portion is substantially rectangularly shaped.

* * * * *